US008040037B2

(12) United States Patent
Kawase

(10) Patent No.: US 8,040,037 B2
(45) Date of Patent: Oct. 18, 2011

(54) IMAGE DISPLAY APPARATUS

(75) Inventor: Toshimitsu Kawase, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 546 days.

(21) Appl. No.: 11/342,598

(22) Filed: Jan. 31, 2006

(65) Prior Publication Data

US 2006/0175955 A1 Aug. 10, 2006

(30) Foreign Application Priority Data

Feb. 4, 2005 (JP) ..... 2005-028931

(51) Int. Cl.
*H01J 1/62* (2006.01)
*H01J 63/04* (2006.01)

(52) U.S. Cl. ..... 313/495

(58) Field of Classification Search ..... 313/495–497
See application file for complete search history.

(56) References Cited

U.S. PATENT DOCUMENTS

| | | | | |
|---|---|---|---|---|
| 6,114,804 | A | 9/2000 | Kawase et al. | 313/495 |
| 6,407,500 | B1 | 6/2002 | Tsuburaya et al. | 313/495 |
| 6,476,547 | B1 | 11/2002 | Kawase | 313/495 |
| 6,528,939 | B1 | 3/2003 | Kawase | 313/495 |
| 6,703,779 | B2 | 3/2004 | Kawase | 313/495 |
| 6,726,520 | B2 | 4/2004 | Takeda et al. | 445/62 |
| 6,858,980 | B2 * | 2/2005 | Kamiguchi | 313/495 |
| 6,885,156 | B2 | 4/2005 | Tajima et al. | 315/169.3 |
| 6,954,030 | B2 | 10/2005 | Kawase | 313/495 |
| 2002/0021081 | A1 * | 2/2002 | Tajima et al. | 313/495 |
| 2003/0025443 | A1 | 2/2003 | Kamiguchi | 313/495 |
| 2003/0141796 | A1 | 7/2003 | Kamiguchi | 313/281 |
| 2004/0008195 | A1 | 1/2004 | Kawase | 345/204 |
| 2004/0127094 | A1 * | 7/2004 | Kamiguchi | 439/521 |
| 2004/0154545 | A1 | 8/2004 | Takeda et al. | 118/728 |

FOREIGN PATENT DOCUMENTS

| | | |
|---|---|---|
| FR | 2 782 835 | 3/2000 |
| JP | 5-114372 | 5/1993 |
| JP | 2000-311594 | 11/2000 |
| JP | 2003-092075 | 3/2003 |
| JP | 2003-229080 A | 8/2003 |

* cited by examiner

*Primary Examiner* — Toan Ton
*Assistant Examiner* — Zachary Snyder
(74) *Attorney, Agent, or Firm* — Fitzpatrick, Cella, Harper & Scinto

(57) ABSTRACT

An image display apparatus includes a hermetic container and an image display member arranged in the hermetic container. The hermetic container is provided with a first substrate, a second substrate arranged to be opposed to the first substrate, and an outer frame arranged between both of the substrates. The first substrate includes an aperture through which an electric power supplying terminal penetrates to the image display member. The aperture is sealed by a sealing member guiding the electric power supplying terminal to an outside of the hermetic container. The sealing member is adhered on a back surface of the first substrate. The back surface is opposite to a surface of the first substrate, on, which the outer frame is arranged. An electroconductive member is arranged between the sealing member and the back surface. The electroconductive member is at predetermined electric potential.

17 Claims, 9 Drawing Sheets

IMAGE DISPLAY APPARATUS

BACKGROUND OF THE INVENTION

1. Field of the Invention

The present invention relates to an image display apparatus having a structure of deriving a terminal for supplying electric power to an image display member in a hermetic container to the outside of the hermetic container.

2. Related Background Art

A flat display panel having a large screen has attracted people's attention in recent years. The flat display panel has a structure as shown in the schematic sectional view of FIG. 10.

A hermetic container is formed of a face plate 33 equivalent to the side of the surface on which an image is displayed, a rear plate 34 arranged to be opposed to the face plate 33, and a seal bonding member 35 performing the seal bonding of the circumferential portions of the face plate 33 and the rear plate 34. Furthermore, an image display member 36 for an image display is arranged in the hermetic container. Electric power is supplied to such an image display member 36 from the outside through a terminal 37, and an image according to an image signal is displayed thereon. Here, the image display member 36 is provided with a control electrode of a kind according to the display system thereof, such as a control electrode controlling the transmission and the non-transmission of light in a liquid crystal display apparatus, a control electrode controlling plasma excitation in a plasma display apparatus, a control electrode for accelerating electrons in an electron beam display apparatus, or the like.

There is the following display apparatus as an example of a conventional electron beam display apparatus, i.e. the display apparatus which radiates the electrons emitted from an electron source to a phosphor to display an image. A container is composed of a front panel (face plate) having a phosphor screen, and a back panel (rear plate) opposed to the front panel with a small interval between them. The display apparatus composed of an electrode structure having a field emission type cathode arranged to be opposed to the phosphor screen in the container is described in Japanese Patent Application Laid-Open No. H05-114372. Moreover, the Japanese Patent Application Laid-Open No. H05-114372 discloses a structure in which electric power is supplied to a power supply conductive layer of a phosphor screen, which layer is equivalent to the image display member, through a terminal penetrating a hole portion formed on a back panel (rear plate).

Moreover, Japanese Patent Application Laid-Open No. 2003-092075 discloses a terminal penetrating a hole portion formed in a rear plate similarly to the electron beam display apparatus disclosed in the Japanese Patent Application Laid-Open No. H05-114372. Furthermore, the Japanese Patent Application Laid-Open No. 2003-092075 discloses a structure in which an electroconductive member which is formed in a ring and arranged around the terminal at predetermined electric potential in order to decrease the damage caused by an abnormal electrical discharge.

Although the electron beam display apparatus described in the Japanese Patent Application Laid-Open No. 2003-092075 adopts a derivation structure of the preferable electric power supplying terminal, which structure can decrease the damage caused by the abnormal electrical discharge, it has been desired to perform still further improvement of the derivation structure of the electric power supplying terminal.

SUMMARY OF THE INVENTION

It is an object of the present invention to provide an image display apparatus having a derivation structure of an electric power supplying terminal which structure is excellent in the decrease of the damage caused by an abnormal electrical discharge.

Moreover, it is another object of the present invention to provide an image display apparatus having a derivation structure of an electric power supplying terminal which structure is also suitable to an image display apparatus having a narrow casing trim.

BRIEF DESCRIPTION OF THE DRAWINGS

FIG. 1A is a perspective view of the external appearance of the image display apparatus and FIG. 1B is a sectional view taken along a line 1B-1B of FIG. 1A;

DETAILED DESCRIPTION OF THE PREFERRED EMBODIMENTS

The present invention is to provide an image display apparatus including: a hermetic container provided with a first substrate, a second substrate arranged to be opposed to the first substrate, and an outer frame arranged between both of the substrates; and an image display member arranged in the hermetic container, wherein the first substrate includes an aperture through which an electric power supplying terminal penetrates to the image display member, the aperture is sealed by a sealing member guiding the electric power supplying terminal to an outside of the hermetic container, the sealing member adhered on a back surface of the first substrate, the back surface opposite to a surface of the first substrate on which the outer frame is arranged; and an electroconductive member is arranged between the sealing member and the back surface, the electroconductive member being at predetermined electric potential.

The present invention is to provide an image display apparatus having a derivation structure of an electric power supplying terminal which structure is excellent in the decrease of the damage by an abnormal electrical discharge.

Moreover, the present invention is to provide an image display apparatus having a derivation structure of an electric power supplying terminal which structure is more suitable also to an image display apparatus of a narrow casing trim.

Figure 1A:
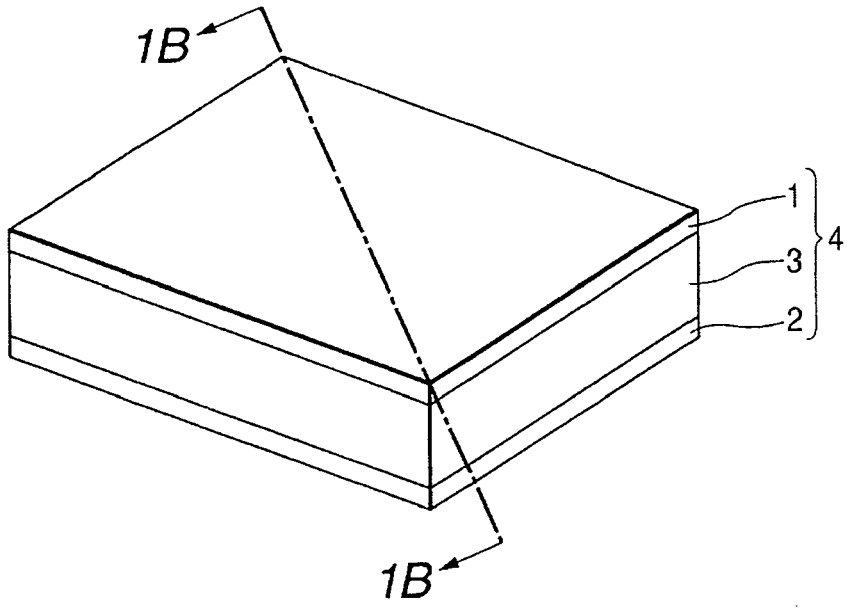
FIGS. 1A and 1B are schematic diagrams showing an embodiment of an image display apparatus of the present invention.
Figure 1B:
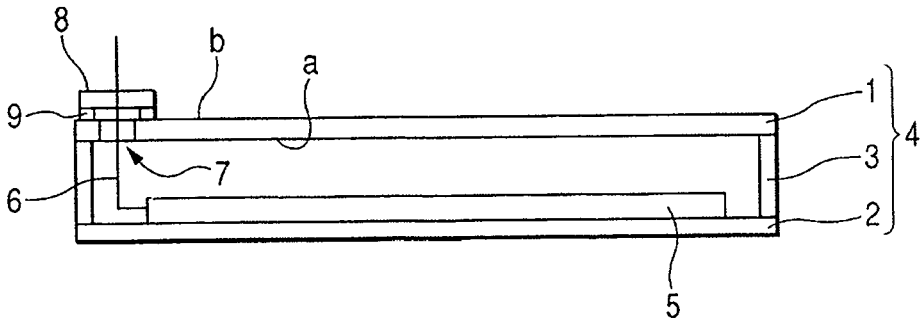

FIGS. 1A and 1B are schematic diagrams showing an embodiment of the image display apparatus of the present invention. FIG. 1A is a perspective view of the external appearance thereof, and FIG. 1B is a sectional view taken along a line 1B-1B of FIG. 1A.

As shown in FIG. 1A, the image display apparatus of the present embodiment is first provided with a hermetic container 4. The hermetic container 4 includes a substrate 1 (a first substrate), a substrate 2 (a second substrate) arranged to be opposed to the substrate 1, and an outer frame 3 arranged between the substrates 1 and 2.

Here, because either the substrate 1 or the substrate 2 functions as an image display surface, at least the image display region of the substrate is made of a member having optical transparency. Moreover, the outer frame 3 performs the seal bonding of the parts between both the substrates, and is composed of a general seal bonding material itself, or of a member worked in the shape of a frame and the seal bonding material adhering the member to both the substrates.

As shown in FIG. 1B, an image display member 5 is arranged in the inner part of the hermetic container 4, and the image display member 5 is different according to the display system. In case of a liquid crystal display apparatus, the image display member 5 is composed of an electrode for controlling the transmission and the non-transmission of light. In case of a plasma display apparatus, the image display member 5 is composed of an electrode for controlling plasma excitation. In case of an electron beam display apparatus, the image display member 5 is composed of an electrode for accelerating electrons.

An electric power supplying terminal 6 electrically connected to the image display member 5 in order to supply predetermined electric potential to the image display member 5 penetrates the inner part of an aperture portion 7 formed in the substrate 1, and is derived to the outside of the hermetic container 4. It is a sealing member 8 that enables to derive the electric power supplying terminal 6 to the outside while maintaining the air tightness of the inner part of the hermetic container 4.

The sealing member 8 is adhered on the side of a surface b (a back surface) opposite to a surface a of the substrate 1, on which the outer frame 3 is arranged, to seal the aperture portion 7. The reason why the sealing member 8 is adhered on the side of the surface b is that it is desired not to arrange an electroconductive member 9 at predetermined electric potential for decreasing the damage caused by an abnormal electrical discharge on the side of the surface a of the substrate 1, but to arrange the electroconductive member 9 on the side of the surface b.

First, the electroconductive member 9 at the predetermined electric potential is provided with an object of decreasing the damage of a not shown member arranged on the surface a of the substrate 1 when an abnormal electrical discharge is generated between the electric power supplying terminal 6 and the not shown member arranged on the surface a of the substrate 1. Alternatively, the electroconductive member 9 is provided with an object of decreasing the damage of the image display member 5 when the abnormal electrical discharge is generated.

The electroconductive member 9 at the predetermined electric potential must be arranged with a certain degree of distance from the electric power supplying terminal 6, or from the not shown member arranged on the surface a of the substrate in order to secure a withstand voltage. The present embodiment can secure the distance without receiving any restrictions of spaces owing to the not shown member arranged on the surface a of the substrate 1, following to the outer frame 3 by arranging the electroconductive member 9 on the side of the surface b of the substrate 1. This fact is suitable for an image display apparatus of the so-called narrow casing trim structure in which the distance between the image display region thereof and the outer frame is narrow.

As mentioned above, the electroconductive member 9 at the predetermined electric potential is arranged between the sealing member 8 and the surface b of the substrate 1, and thereby the aperture portion 7 is sealed by the sealing (member 8.

In the following, examples of desirable embodiments of the present invention are cited, and the present invention is further described in detail.

Embodiment 1

Figure 2:
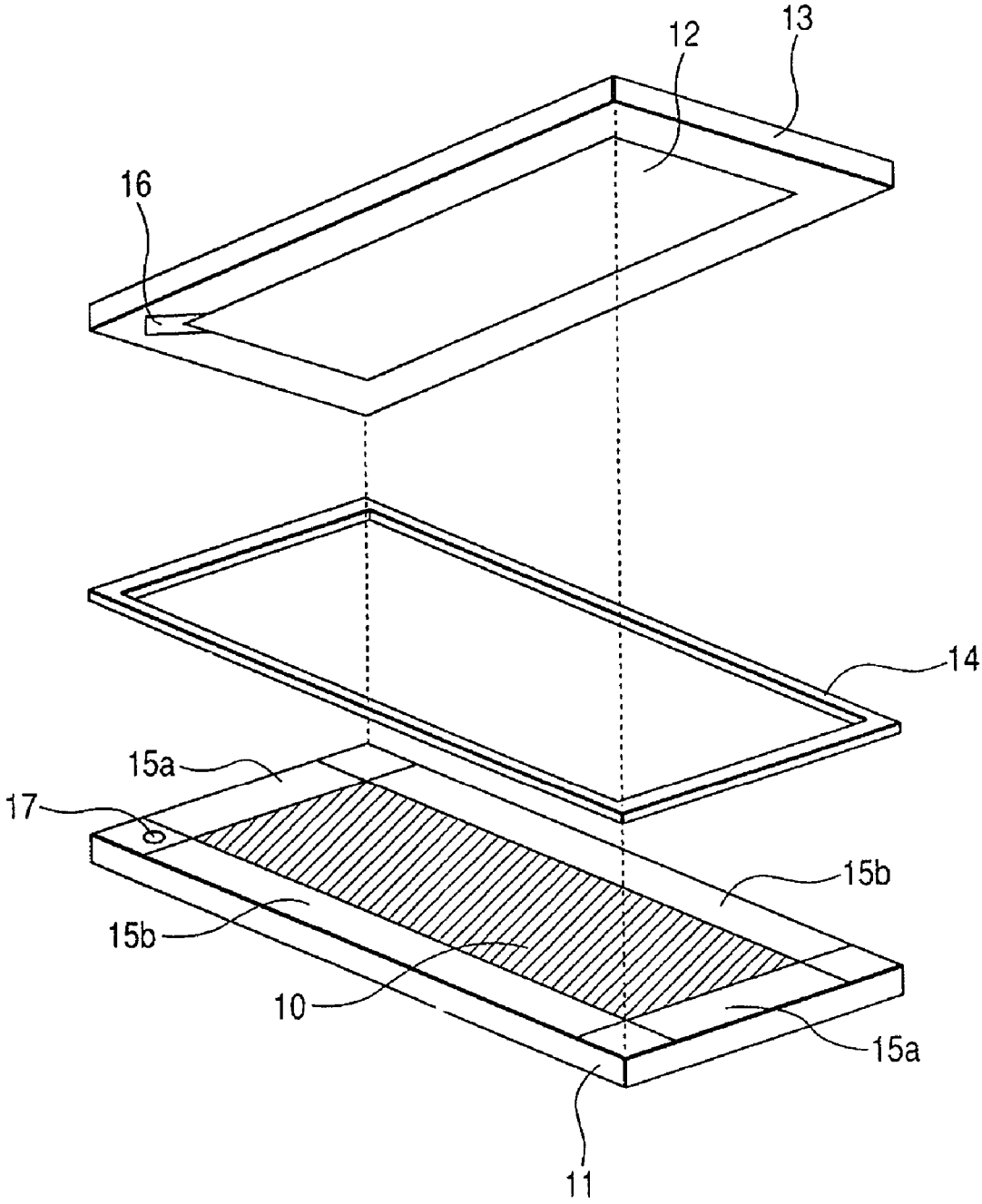
FIG. 2 is an exploded perspective view schematically showing the configuration of the image display apparatus of the embodiment.

An electron beam display apparatus is cited as an example, and the present embodiment is described in the following. FIG. 2 is an exploded perspective view schematically showing the configuration of the image display apparatus of the present embodiment. As shown in FIG. 2, a rear plate (a first substrate) 11, on which an electron source 10 is arranged, and a face plate (a second substrate) 13, on which the image display member 12 is arranged, are arranged to be opposed to each other. Moreover, an outer frame 14 is arranged between the rear plate 11 and the face plate 13, and the rear plate 11, the face plate 13 and the outer frame 14 constitute a hermetic container. Moreover, the inner part of the hermetic container is made to be in a depressurized atmosphere, preferably within a range of from $10^{-4}$ Pa to $10^{-6}$ Pa.

The electron source 10 mentioned above is composed of a plurality of electron-emitting devices connected with one another with wiring. For example, as shown in FIG. 3, the electron source 10 is configured to be in the matrix wiring of a plurality of electron-emitting devices 18 with a plurality of wires of row direction wiring 19*a* and a plurality of wires of column direction wiring 19*b*, which are arranged with insulating layers 20 put between them Moreover, well known devices are applied as the electron-emitting devices 18, and the well known devices are preferably a field emission type device (field emitter (FE)), a surface conduction electron-emitting device, an MIM type device and the like.

Figure 4:
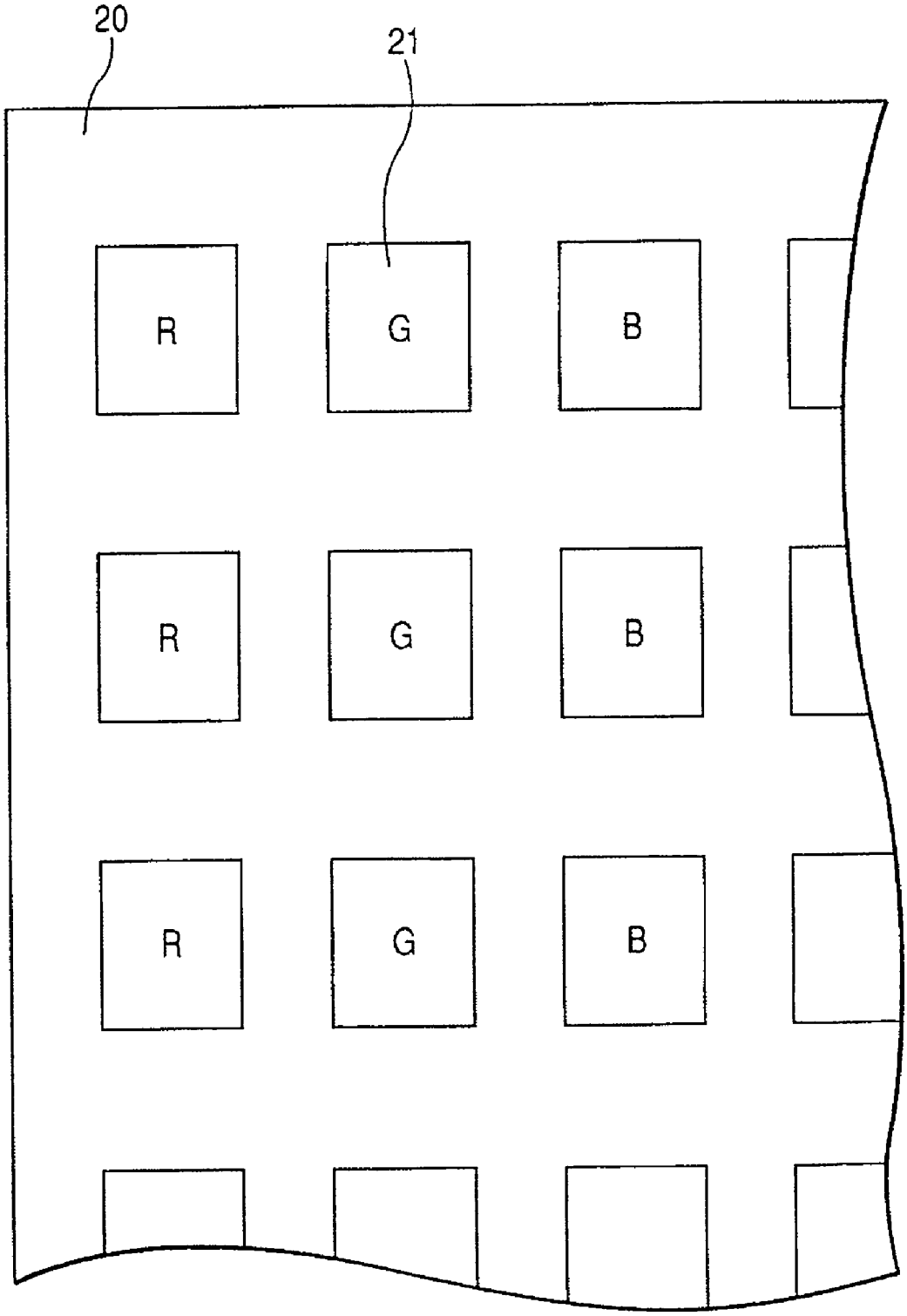
FIG. 4 is a plan view schematically showing an example of a phosphor film.

Moreover, the image display member 12 mentioned above is provided with a phosphor film and an acceleration electrode accelerating the electrons emitted from the electron source 10. The phosphor film is, for example, as shown in FIG. 4, composed of phosphors 21 of red (R) ones, green (G) ones and blue (B) ones, and a non-luminous member 22 arranged among the phosphors. Moreover, the accelerating electrode is, for example, a metal back provided to cover the phosphor film.

Moreover, the outer frame 14 is composed of a member worked into a frame, and a seal bonding material made of glass, a metal or the like, which adheres the frame-like member to both the substrates of the rear plate 11 and the face plate 13. Incidentally, various materials such as soda lime glass, soda lime glass having $SiO_2$ film formed on the surface thereof, glass having the lessened content of Na, silica glass and the like cat be used for the rear plate 11, the face plate 13 and the frame-like member, which have been described above.

Figure 3:
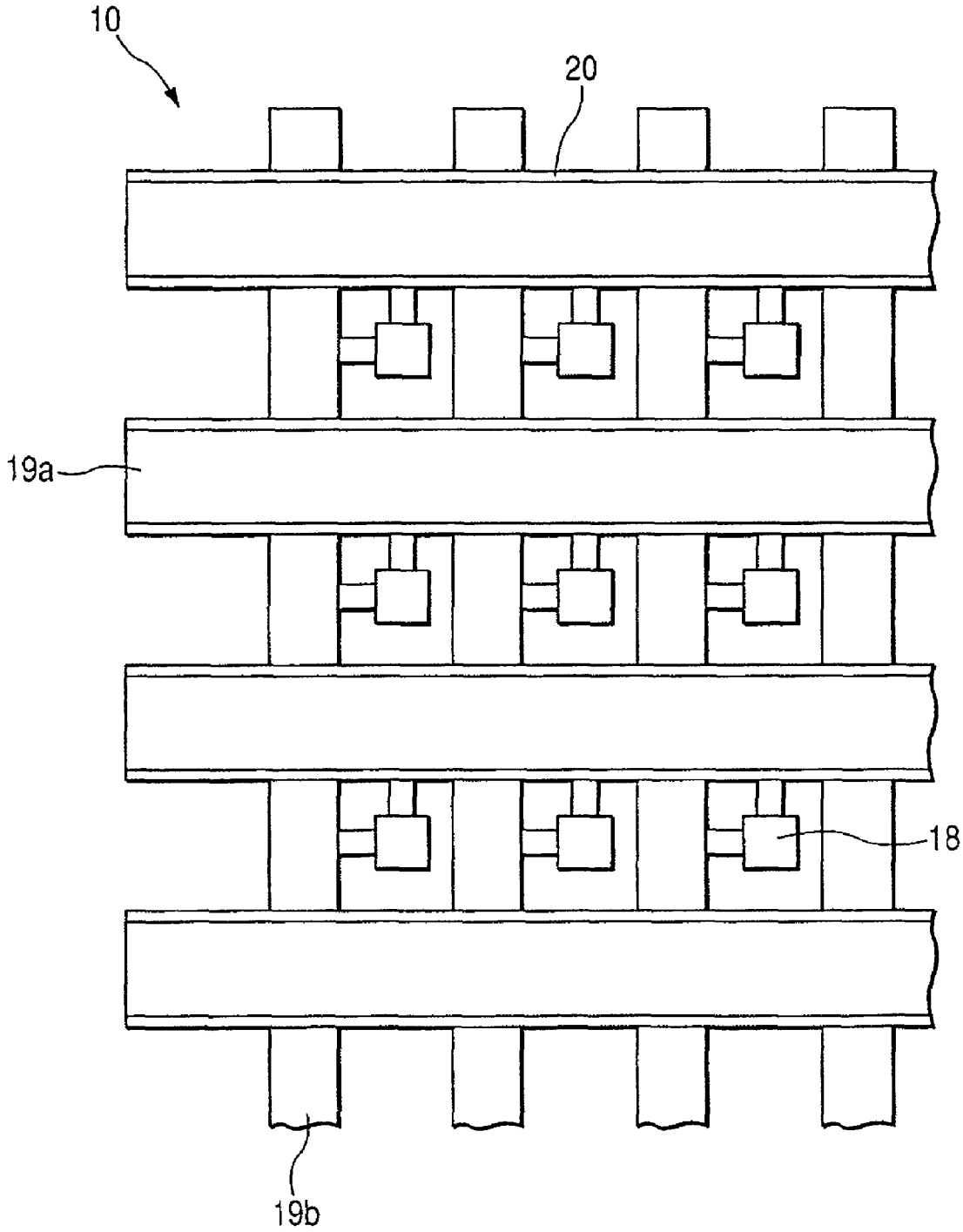
FIG. 3 is a plan view schematically showing an example of an electron source composed of a plurality of electron-emitting devices connected with wiring to one another.

Moreover, the row direction wiring 19*a* and the column direction wiring 19*b*, both shown in FIG. 3, are connected with leading wiring 15*a* and 15*b*, both shown in FIG. 2, respectively. Moreover, the leading wiring 15*a* and 15*b* is laid under the insulative seal bonding material coated between the rear plate 11 and the outer frame 14, and is pulled out to the outside of the hermetic container to be connected with the external power source for the drive of the electron source. On the other hand, the metal back mentioned above is connected with leading wiring 16 extending toward a corner of the face plate 13. The leading wiring 16 is connected with an electric power supplying terminal 25 shown in FIG. 5 which penetrates the inner part of an aperture portion 17 formed on a corner of the rear plate 11 to be pulled out to the outside of the hermetic container and is connected with an external power source for supplying electric potential to the metal back. For example, low electric potential within a range of from 10 V to 100 V is supplied to the electron source 10 on the side of the rear plate 11 based on an image signal by the external power source mentioned above. On the other hand, for example, high electric potential within a range of 500 V to 30 kV is supplied to the metal back on the side of the face plate 13 by the external power source mentioned above. Thereby, electrons emitted from the electron source 10 are accelerated to irradiate the phosphor. Then, the display of an image is performed.

In the following, the method of the electric connection of the metal back with the external power source for supplying electric potential to the metal back is described.

Figure 5:
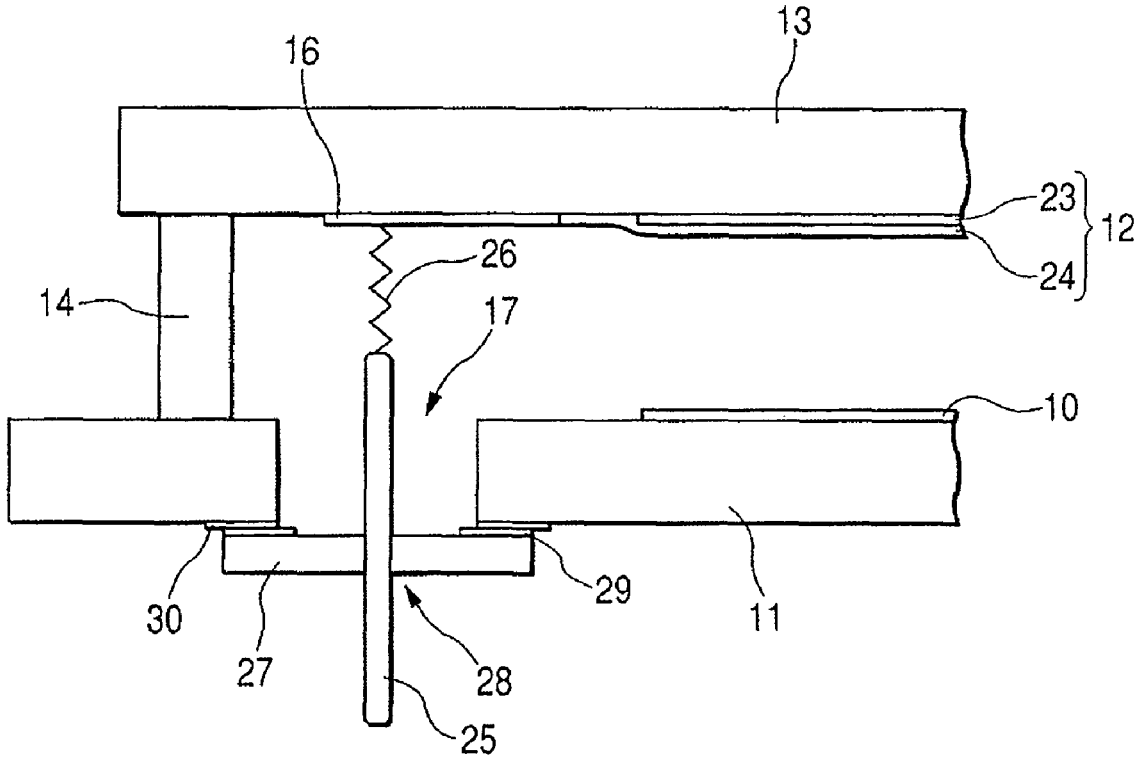
FIG. 5 is a partially enlarged sectional view of a derivation portion from a hermetic container of an electric power supplying terminal of the image display apparatus of the embodiment.

FIG. 5 is a partially enlarged sectional view of a derivation portion for deriving from the hermetic container the electric power supplying terminal 25 electrically connected with the metal back 24 covering the phosphor film 23 mentioned above in the image display apparatus of FIG. 2 mentioned above. The electric power supplying terminal 25 is electrically connected with the leading wiring 16 connected to the metal back 24 on the side of the face plate 13 with an elastic member 26 put between them. Furthermore, the electric power supplying terminal 25 penetrates the inner part of the aperture portion 17 of the rear plate 11, and also penetrates the sealing member 27 to be derived to the outside of the hermetic container composed of the rear plate 11, the face plate 13 and the outer frame 14. Then, the electric power supplying terminal 25 is connected with the not shown external power source.

Here, the leading wiring 16 is made of an electrocnductive material such as Ag, and is formed by a printing method or the like. Moreover, the elastic member 26 is, for example, a spring member made of an electroconductive material such as stainless. Because the spring member makes the electric connection between the electric power supplying terminal 25 and the leading wiring 16 more sure by depressing the leading wiring 16, it is preferable to provide the spring member.

Incidentally, the spring member may be not provided if it is not necessary. In this case, the electric power supplying terminal 25 may be directly contacted with the leading wiring 16.

The electric power supplying terminal 25 is a member which is made of an electroconductive material such as Ag, Cu, a Ni—Co alloy material or the like and has a diameter within a range of 0.3 mm to 1.0 mm.

In case of providing the elastic member 26, the electric power supplying terminal 25 is connected to such an elastic member by a method such as laser welding, an electrically conductive adhesive material, a metal junction or the like. Moreover, the aperture portion 17 of the rear plate 11, which the electric power supplying terminal 25 penetrates, is formed to be a circle having a diameter within a range of from 1.5 mm to 2.5 mm, and is formed by machine work using an ultrasonic processing machine or the like.

Moreover, the sealing member 27 is, for example, a circular plate-like member which is made of a ceramic such as alumina and glass and has a diameter within a range of from 4.5 mm to 5.5 mm. Furthermore, at the central part of the sealing member 27, the sealing member 27 has a hole 28, which the electric power supplying terminal 25 penetrates, and the sealing member 27 holds the electric power supplying terminal 25 with the hole 28 portion to derive the electric power supplying terminal 25 to the outside of the hermetic container. Incidentally, the electric power supplying terminal 25 and the hole 28 are hermetically sealed by being brazed with a brazing material such as Ag—Cu, Au—Ni or the like.

Figure 6:
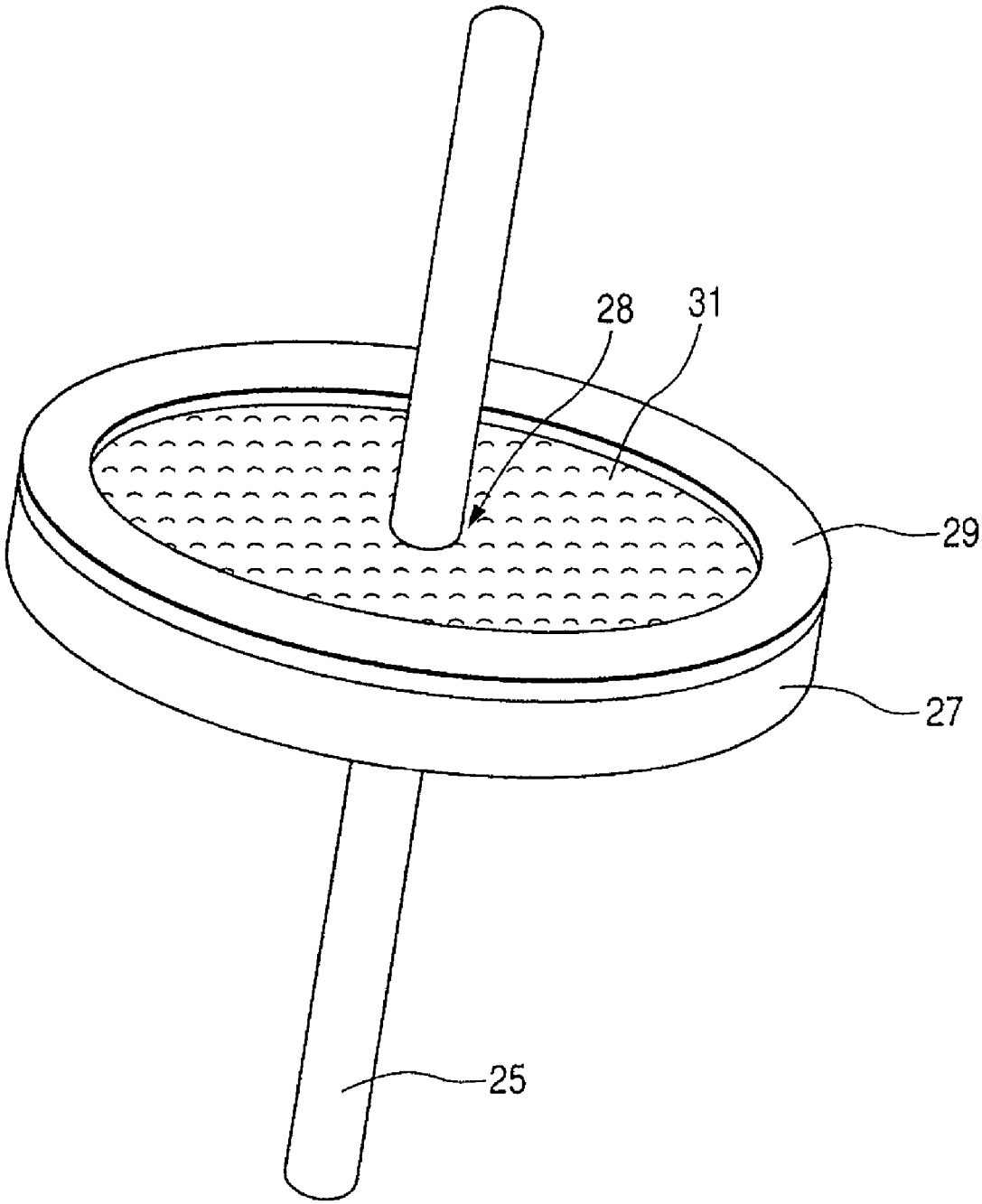
FIG. 6 is a perspective view schematically showing an example of a sealing member according to the embodiment.

Furthermore, the sealing member 27 before being adhered to the rear plate 11 is shown in FIG. 6. FIG. 6 is a schematic perspective view showing the sealing member 27 when it is seen from the side of the surface of the member 27 which is adhered to the rear plate 11 in FIG. 5.

An electroconductive member 29 is arranged on the side of the surface of the sealing member 27 which is adhered to the rear plate 11. The electroconductive member 29 is a ring-like member which is made of, for example, Ag, In or the like and has an inner diameter within a range of from 1.5 mm to 3.0 mm with the electric power supplying terminal at the center of the ring. The electroconductive member 29 is formed on the sealing member 27 by a printing method or an ordinary coating method.

Incidentally, as long as the sealing member 27 can seal the aperture portion 17 in FIG. 5, the form of the sealing member 27 is not limited to the circle, and also the form of the aperture portion 17 is not limited to the circle. Furthermore, also the form of the electroconductive member 29 is not necessarily the ring-like one. The structure will do as long as at least an electroconductive member is arranged between the electric power supplying terminal 25 and the electron source 10 on the rear plate 11. In the case where the leading wiring 15*a* and 15*b* as shown in FIG. 2 exists, it is preferable that the electroconductive member is further arranged between such leading wiring and the electric power supplying terminal 25. Incidentally, the form of the electroconductive member 29 is preferably the ring-like one from the viewpoint of the capability of the reduction of the concentration of an electric field.

Moreover, irregularities 31 are formed between the electroconductive members 29 and the electric power supplying terminals 25 on the surface of the sealing member 27 shown in FIG. 6. The irregularities 31 are preferably provided because they increase the creeping distance between the electroconductive member 29 and the electric power supplying terminal 25 and thereby can further improve the withstand voltage (withstanding voltage property) between the electroconductive member 29 and the electric power supplying terminal 25. However, the irregularities 31 are not indispensable. Moreover, the irregularities 31 are formed by, for example, a sand blast method or the like.

The sealing member 27, which has been described above and is shown in FIG. 6, is adhered to the back surface of the rear plate 11, which is opposite to the surface on which the outer frame 14 is arranged, as shown in FIG. 5 so that the electric power supplying terminal 25 may penetrate almost the center of the aperture portion 17 and may abut against the leading wiring 16. In this case, In, Bi, Sn, an alloy of them, or the like is used as a metal seal bonding material 30. Moreover, the seal bonding material 30 is coated on the sealing member 27 or the back surface of the rear plate 11 so that the seal bonding material 30 may be electrically connected with the electroconductive member 29. Then, the electroconductive member 29 is electrically connected with a not shown power source on the outside of the hermetic container through the metal seal bonding material 30 after the adhesion of the sealing member 27. Predetermined electric potential is applied to the electroconductive member 29 from the not shown power source. Here, the predetermined electric potential is the electric potential lower than that supplied from the external power source to the electric power supplying terminal 25, and is preferably the grand electric potential.

Moreover, it is preferable that the electroconductive member 29 itself is made of the metal seal bonding material 30 because it becomes unnecessary to use the seal bonding material 30 separately and it also becomes unnecessary to be apprehensive of bad connection of the seal bonding material and the electroconductive member.

Embodiment 2

The present embodiment is one in which a resistance film is provided in place of the irregularities 31 in the sealing member 27 of Embodiment 1 shown in FIG. 6, and the other components are similar to those of Embodiment 1.

Figure 7:
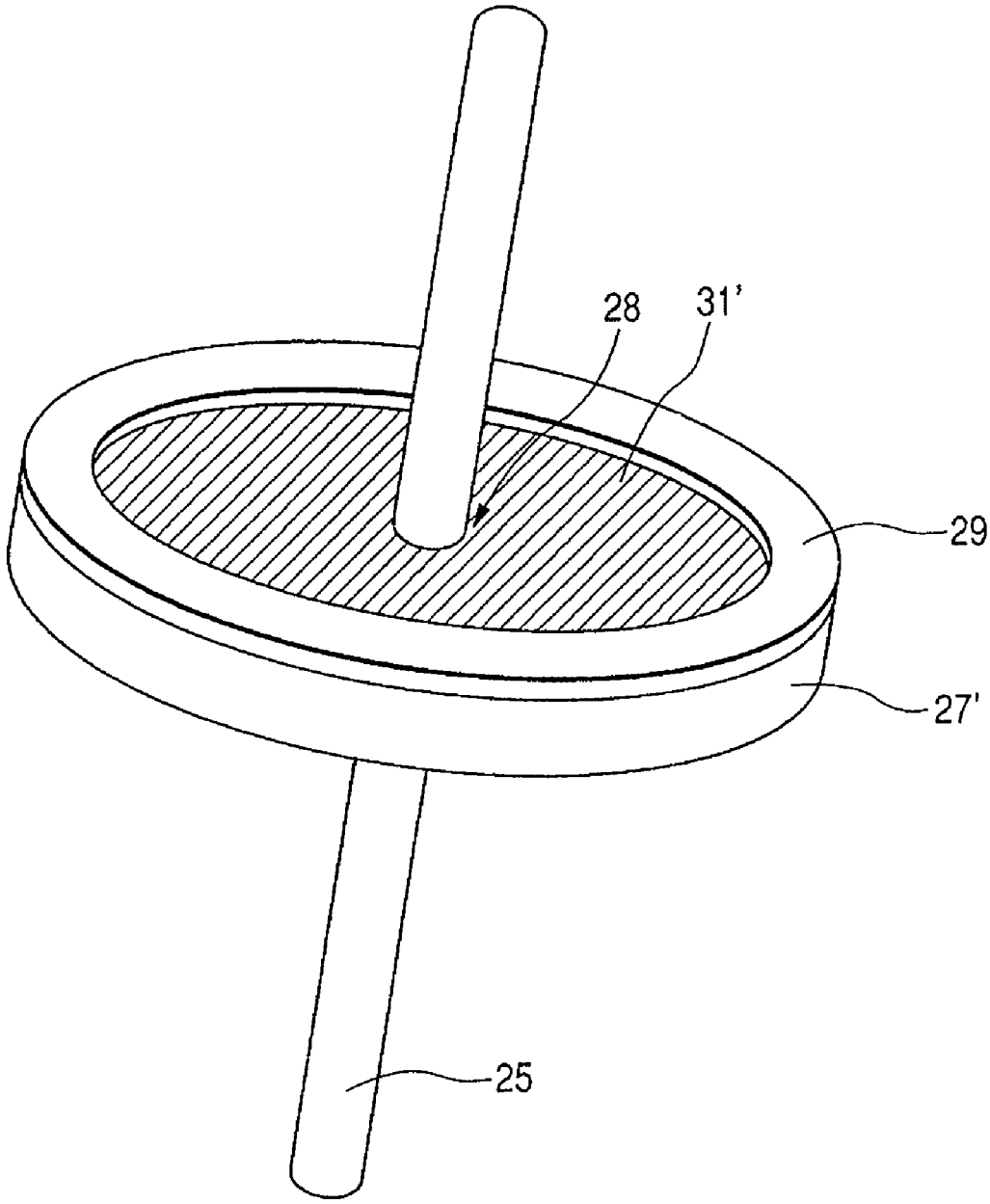
FIG. 7 is a perspective view schematically showing an example of the sealing member according to another embodiment.

FIG. 7 is a schematic perspective view of a sealing member 27 of the present embodiment when it is seen from the side of the surface adhered to the rear plate 11 in FIG. 5.

First, the electroconductive member 29, the electric power supplying terminal 25 and the hole 28, which the electric power supplying terminal 25 penetrates, are similarly formed to those of Embodiment 1. Moreover, as shown in FIG. 7, a resistance film 31' is provided between the electroconductive member 29 and the electric power supplying terminal 25 so as to be connected with the electroconductive member 29 and the electric power supplying terminal 25 in place of the regularities 31 described as to Embodiment 1.

Similarly to the irregularities 31 in Embodiment 1, the resistance film 31' is preferably provided in order to further improve the withstand voltage (withstanding voltage property) between the electroconductive member 29 and the electric power supplying terminal 25. The resistance film 31' is a film which is made of, for example, $SnO_2$ doped with W—Ge—N and Sb, or the like and has the sheet resistance within a range of from $1\times10^7$ Ω/□ to $1\times10^{13}$ Ω. The resistance film 31' is formed by the sputtering method, and coating and burning.

The sealing member 27' shown in FIG. 7, which is mentioned above, is adhered to the back surface of the rear plate 11, which is opposite to the surface on which the outer frame 14 is arranged, as shown in FIG. 5 similarly in Embodiment 1. In this case, the sealing member 27' is adhered so that the electric power supplying terminal 25 may penetrate almost the center of the aperture portion 17 and may abut against the leading wiring 16. Although the seal bonding material 30 of the material such as In, Bi, Sn, their alloy or the like is used, the electroconductive member 29 itself may be the one having the function as the seal bonding material. Furthermore, such an electroconductive member 29 is electrically connected with the not shown power source on the outside of the hermetic container, and the predetermined potential is applied to the electroconductive member 29 from the not shown power source.

Figure 8:
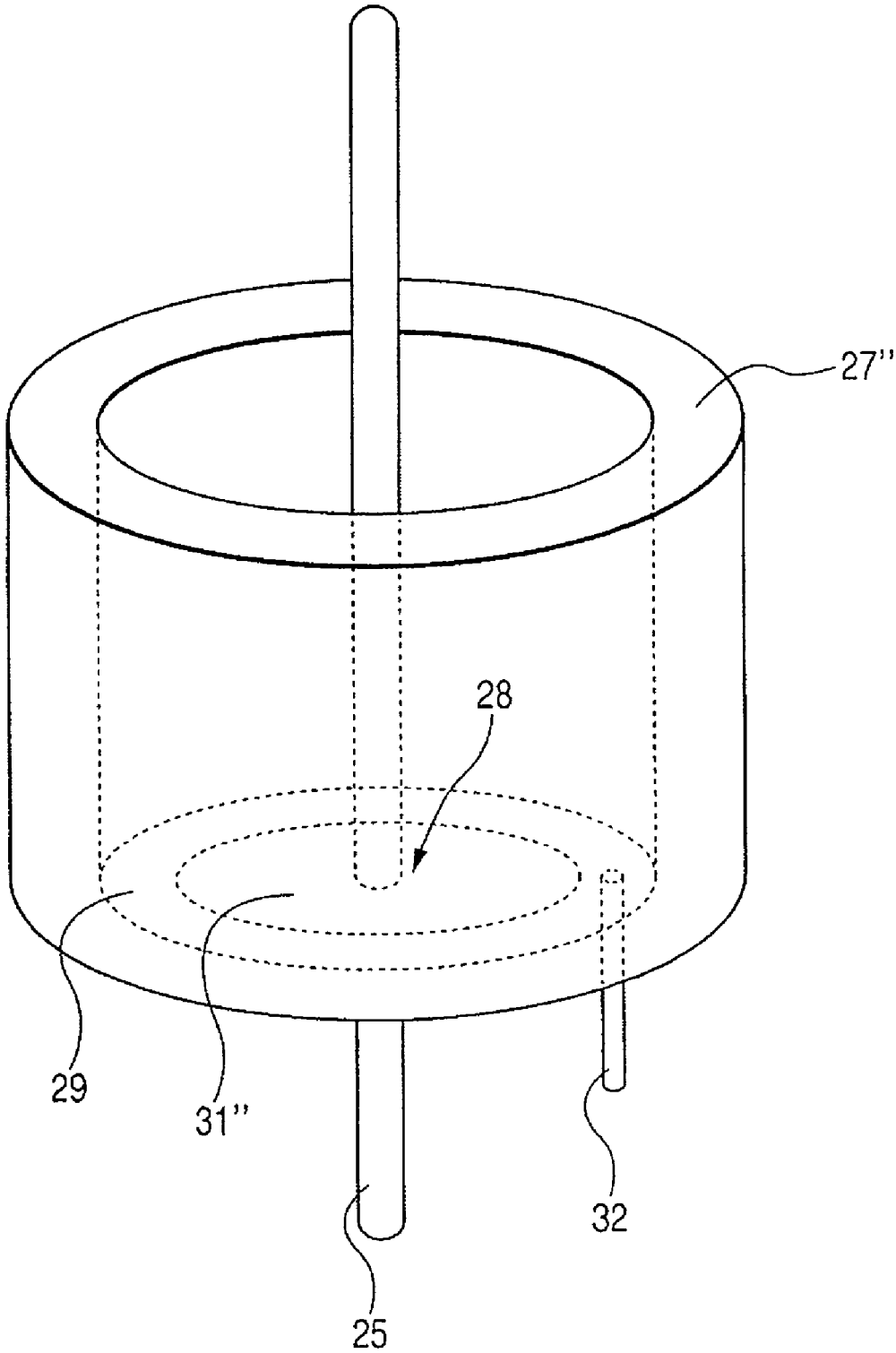
FIG. 8 is a perspective view schematically showing an example of the sealing member according to a further embodiment.

Incidentally, in the embodiments described above, although each of the sealing members 27 and 27' is a plate-like member, the shapes of the sealing members 27 and 27' are not limited to the plate-like member. For example, as shown in FIG. 8, a cap-like sealing member 27" having the electroconductive member 29, and the irregularities or a resistance film 31", all arranged at the bottom of the inner part of the cap-like sealing member 27" may be used. Even in such a case, it is possible to set the electroconductive member 29 at the predetermined electric potential by separately providing a conductor 32 electrically connecting the not shown external power source with the electroconductive member 29 to be derived from a hermetically sealed hole similar to the hole 28, through which the electric power supplying terminal 25 is derived.

That is, the electroconductive member at the predetermined electric potential according to the present invention will do as long as the electroconductive member is arranged between the back surface and the sealing member. The back surface is opposite to the surface of the substrate on which the outer frame is arranged. The electric power supplying terminal is derived from the substrate.

Example

An image display apparatus of the present example is described in the following using FIGS. 2 to 4, 7 and 9.

First, 0.5 μm of a $SiO_2$ layer was formed on the surface of cleansed soda lime glass by sputtering, and the rear plate 11 in which the aperture portion 17, which had a diameter of 2 mm and was shown in FIG. 2, was formed using an ultrasonic processing machine was prepared.

Next, the electron source 10 was formed on the rear plate 11 by the printing method or the like. As shown in FIG. 3, the electron source 10 was composed of the plurality of electron-emitting devices 18 wired in a matrix using the plurality of the wires of the row direction wiring 19*a* and the plurality of the wires of the column direction wiring 19*b* with the insulating layers 20 between them. A surface conduction electron-emitting device was formed as an electron-emitting device 18 here. The surface conduction electron-emitting device, the wiring and the insulated layer were able to be formed by well known methods, for example, a method disclosed in Japanese Patent Application Laid-Open No. 2000-311594 or the like.

Moreover, as the member constituting the outer frame 14 shown in FIG. 2, a frame-like member which was produced by performing the machine working of soda lime glass in the shape of a frame was used. Moreover, the phosphor film composed of the phosphors 21 of red (R) ones, green (G) ones and blue (B) ones and the non-luminous member (black matrix) 22 arranged among the phosphors 21, all shown in FIG. 4, was formed on the soda lime glass. Moreover, the metal back made of Al was formed on the whole surface of the phosphor film by sputtering. In such a way, the face plate 13 on which the image display member 12 composed of the phosphor film and the metal back was arranged, and the outer frame 14, all shown in FIG. 2, were prepared.

Incidentally, the leading wiring 16 connected to the metal back of the face plate 13 was formed by coating an Ag paste by the printing method, and by burning it.

Next, the sealing member 27' as shown in FIG. 7 was produced by machining soda lime glass. The sealing member 27' had the hole 28 in the central part thereof, and was produced to have a diameter of 5 mm and a thickness of 1 mm. Moreover, the electric power supplying terminal 25 which had a diameter of 0.6 mm and the length of 5 mm and was made of a Ni—Co alloy was penetrated in the hole 28 of the sealing member 27'. Then, the electric power supplying terminal 25 was brazed to be fixed to the sealing member 27' with a brazing material of Au—Ni, and thereby the hole 28 was hermetically sealed.

Next, a solution of fine particles of tin oxide and antimony oxide, both dispersed in an organic solvent, was coated on one surface of the sealing member 27', and the surface of the sealing member 27' was burned to form the resistance film 31' having sheet resistance of $10^9$ Ω/□.

Figure 9:
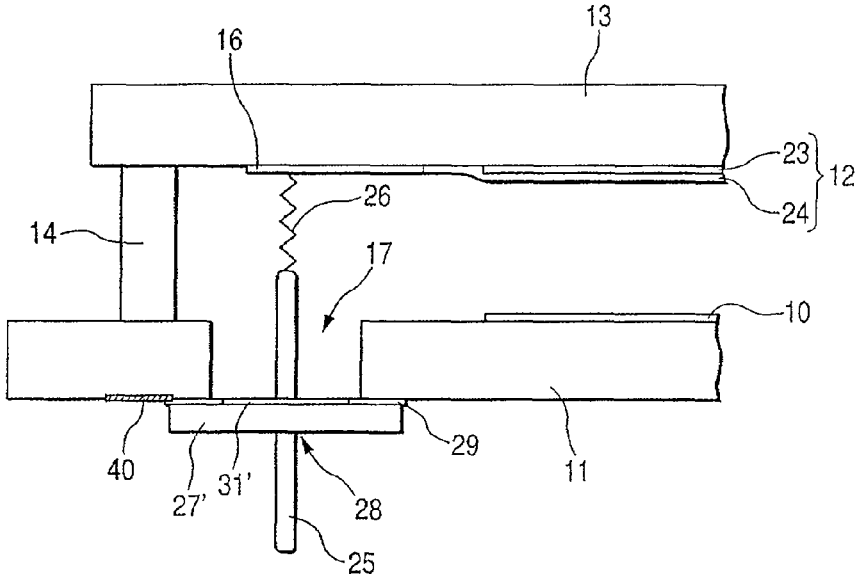
FIG. 9 is a partially enlarged sectional view of the derivation portion from the hermetic container of the electric power supplying terminal in an image display apparatus of an example.
Figure 10:
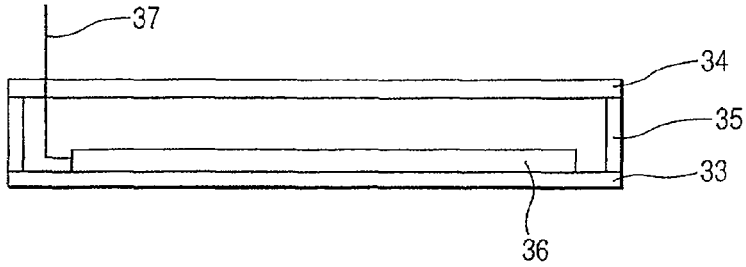
FIG. 10 (PRIOR ART)
FIG. 10 is a schematic sectional view of a conventional flat display panel.

Furthermore, a spring material which was made of stainless and had a diameter of 1.5 mm was fixed to the electric power supplying terminal 25 by the spot welding to form the elastic member 26 shown in FIG. 9. The length of the elastic member 26 was set so that the elastic member 26 might depress the leading wiring 16 as shown in FIG. 9 at the time of forming the hermetic container formation, which would be described later.

Melted In was coated in the shape of a ring having a width of 1 mm from the outer edge of the sealing member on a part of the resistance film 31' of the sealing member 27' described above, and the surface on which the In was coated was adhered to the circumference of the aperture portion 17 on the back surface of the rear plate 11 (the surface on which the electron source 10 was not formed) by pushing the surface against the circumference while heating the surface. On this occasion, position adjustment was performed so that the electric power supplying terminal 25 might be located at almost the center of the aperture portion 17, and a part of a copper wire having a diameter of 0.5 mm was laid under the In to arrange a fetch wire 40 as shown in FIG. 9.

In the preset example, the In itself, which was used for the adhesion of the sealing member, fulfilled the role of the electroconductive member 29 regulating the electric potential at the circumference of the electric power supplying terminal 25.

Next, the frame-like member mentioned above was adhered to be fixed to the surface of the rear plate 11 on which the sealing member 27' was adhered (the surface on which the electron source 10 was formed) using frit glass, which was the seal bonding material. Furthermore, In was coated as the seal bonding material on the side of the surface of the frame-like member which abutted against the face plate 13 shown in FIG. 9.

The rear plate 11 on which the sealing member and the frame-like member were adhered to be fixed and the face plate 13 mentioned above was arranged in a depressurized atmosphere of the pressure of $10^{-6}$ Pa. Then, the In coated on the surface of the frame-like member abutting against the face plate 13 was heated to be melted, and the position adjustment of the rear plate 11 and the face plate 13 was performed to perform the seal bonding of both the plates.

In the manner mentioned above, a hermetic container was produced. The hermetic container was produced which was composed of the rear plate 11, the outer frame 14 and the face plate 13. The outer frame 14 was composed of the frame-like member and the seal bonding material. The hermetic container therein contained the electron source 10 and the image display member 12 composed of the phosphor film 23 and the metal back 24.

As shown in FIG. 9, the electric power supplying terminal 25 was connected to the leading wiring 16 with the elastic member 26 put between them. The leading wiring 16 was connected to the metal back 24 in the hermetic container. High electric potential within a range of from 500 V to 30 kV was supplied from the outside of the hermetic container to the leading wiring 16 by the not shown power source. Moreover, in the present example, the fetch wire 40 was set at the electric potential, and consequently the electroconductive member 29 connected to the fetch wire 40 was set at the ground electric potential.

According to the image display apparatus of the present example described above, it was able to decrease the damage to the electron source as much as possible. The damage was caused by an abnormal electrical discharge near the electric power supplying terminal 25, to which high electric potential was supplied. Moreover, it was also able to be said that the derivation structure of the electric power supplying terminal became more suitable one also to the image display apparatus having a narrow casing trim.

This application claims priority from Japanese Patent Application No. 2005-028931 filed Feb. 4, 2005, which is hereby incorporated by reference herein.

What is claimed is:

1. An image display apparatus, comprising:

a hermetic container including a first substrate with an aperture, a second substrate arranged to be opposed to the first substrate, and an outer frame arranged between both of the substrates;

an image display member arranged on an inner surface of the second substrate on which the outer frame is arranged, a sealing member arranged on an outer surface of the first substrate opposite to an inner surface of the first substrate on which the outer frame is arranged, so as to seal the aperture, an electric power supplying terminal penetrating the sealing member through the aperture so as to extend from an internal space of the hermetic container to an external space and to be electrically connected to the image display member, wherein the sealing member comprises an electroconductive member with a ring shape disposed around the electric power supplying terminal and adhered to the outer surface of the first substrate, and the electroconductive member is kept at an electric potential lower than that supplied to the image display member, and wherein a surface of the sealing member between the electroconductive member and the electric power supplying thermal has irregularities so as to increase a creeping distance between the electroconductive member and the electric power supplying terminal.

2. An image display apparatus according to claim 1, wherein the electroconductive member is kept at ground electric potential.

3. An image display apparatus according to claim 1, wherein an electron source is arranged on the first substrate in the hermetic container, and the image display member including a phosphor and an accelerating electrode of electrons emitted from the electron source arranged on the second substrate in the hermetic container.

4. An image display apparatus according to claim 1, further comprising a power source for supplying the electroconductive member with a potential lower than that supplied to the image display member.

5. An image display apparatus according to claim 1, wherein the sealing member maintains air tightness at the inner part of the hermetic container.

6. An image display apparatus according to claim 5, wherein the electroconductive member seal bonding member is in an ultra high vacuum atmosphere within a range of from $10^{-4}$ Pa to $10^{-6}$ Pa.

7. An image display apparatus according to claim 1, wherein the electroconductive member is made of a metal seal bonding material.

8. An image display apparatus according to claim 1, wherein the sealing member is made of glass or ceramic.

9. An image display apparatus, comprising:

a hermetic container including a first substrate, a second substrate arranged to be opposed to the first substrate, an outer frame arranged between both of the substrates, a sealing member, and a seal bonding member disposed between the sealing member and the first substrate;

an image display member arranged on an inner surface of the second substrate and facing the first substrate in the hermetic container, wherein the first substrate includes an aperture with peripheral edge portions, and an electric power supplying terminal electrically connected to the image display member and penetrating the sealing member through the aperture such that the electric power supplying terminal extends from an internal space in the hermetic container, wherein the sealing member covers the peripheral edge portions and seals the aperture, with the sealing member adhered on a back surface of the first substrate with an electroconductive member surrounding the electric power supplying terminal, and with the back surface being opposite to a surface of the first substrate on which the outer frame is arranged, and the electroconductive member arranged between the sealing member and the back surface, the electroconductive member is kept at an electric potential lower than that supplied to the image display member, and wherein the sealing member has a hole through which the electric power supplying terminal penetrates.

10. An image display apparatus according to claim 9, wherein the electroconductive member is kept at ground electric potential.

11. An image display apparatus according to claim 9, wherein a surface of the sealing member between the electroconductive member and the electric power supplying terminal has irregularities.

12. An image display apparatus according to claim 9, wherein an electron source is arranged on the first substrate in the hermetic container, and the image display member including a phosphor and an accelerating electrode of electrons emitted from the electron source arranged on the second substrate in the hermetic container.

13. An image display apparatus according to claim 9, further comprising a power source for supplying the electroconductive member with a potential lower than that supplied to the image display member.

14. An image display apparatus according to claim 9, wherein the sealing member maintains air tightness at the inner part of the hermetic container.

15. An image display apparatus according to claim 14, wherein the electroconductive member seal bonding member is in an ultra high vacuum atmosphere within a range of from $10^{-4}$ Pa to $10^{-6}$ Pa.

16. An image display apparatus according to claim 9, wherein the electroconductive member is made of a metal seal bonding material.

17. An image display apparatus according to claim 9, wherein the sealing member is made of glass or ceramic.

* * * * *